US007144273B1

(12) United States Patent
Chawgo

(10) Patent No.: US 7,144,273 B1
(45) Date of Patent: Dec. 5, 2006

(54) INSULATED CABLE ATTACHMENT DEVICE

(75) Inventor: Shawn Chawgo, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/230,053

(22) Filed: Sep. 19, 2005

(51) Int. Cl.
*H01R 9/05* (2006.01)

(52) U.S. Cl. ..... 439/583; 439/578

(58) Field of Classification Search ..... 439/578, 439/583, 584, 585
See application file for complete search history.

(56) References Cited

U.S. PATENT DOCUMENTS

| | | | | |
|---|---|---|---|---|
| 2,743,505 | A | 5/1956 | Hill | |
| 2,793,352 | A | 5/1957 | Bird | |
| 3,678,444 | A | 7/1972 | Stevens et al. | |
| 4,045,113 | A | 8/1977 | Iacono | |
| 4,096,350 | A | 6/1978 | Mayr et al. | |
| 4,249,790 | A * | 2/1981 | Ito et al. | 439/583 |
| 4,538,869 | A | 9/1985 | Richards | |
| 6,089,913 | A | 7/2000 | Holliday | |
| 6,491,546 | B1 | 12/2002 | Perry | |
| 6,530,807 | B1 | 3/2003 | Rodrigues et al. | |
| 6,648,674 | B1 * | 11/2003 | Dobler | 439/460 |
| 6,767,247 | B1 | 7/2004 | Rodrigues et al. | |
| 6,767,249 | B1 | 7/2004 | Li | |
| 6,783,394 | B1 | 8/2004 | Holliday | |
| 6,817,896 | B1 | 11/2004 | Derenthal | |
| 2002/0164900 | A1 | 11/2002 | Youtsey | |
| 2003/0052755 | A1 | 3/2003 | Barnes et al. | |
| 2003/0127242 | A1 | 7/2003 | Pilling et al. | |
| 2003/0162439 | A1 | 8/2003 | Rodrigues et al. | |
| 2004/0147164 | A1 | 7/2004 | Li | |
| 2004/0175990 | A1 | 9/2004 | Fox | |
| 2004/0185713 | A1 | 9/2004 | Holliday | |
| 2004/0209516 | A1 | 10/2004 | Burris et al. | |
| 2004/0253870 | A1 | 12/2004 | Johnson | |
| 2005/0003705 | A1 | 1/2005 | Rodrigues et al. | |
| 2005/0048836 | A1 | 3/2005 | Holliday | |
| 2005/0181667 | A1 * | 8/2005 | Kao | 439/578 |
| 2005/0191903 | A1 * | 9/2005 | Goodwin et al. | 439/578 |

* cited by examiner

*Primary Examiner*—Tho D. Ta
(74) *Attorney, Agent, or Firm*—Christopher R. Pastel; Pastel Law Firm

(57) ABSTRACT

An insulated cable attachment device, made of an electrically insulating material, is connectable to a termination connector which is in turn connectable to a tap port for a cable television system. When an installer disconnects service to a subscriber's house, the signal is shut down to the tap port to which the subscriber drop cable is connected. The drop cable is disconnected from the tap port and a terminator connector is connected in its place on the tap port. The installer then installs the insulated cable attachment device onto the terminator connector before connecting the drop cable to the insulated cable attachment device, thereby preventing any difference in ground potentials between the terminal connector and the drop cable from being transmitted to the end of the drop cable near the house.

8 Claims, 3 Drawing Sheets

INSULATED CABLE ATTACHMENT DEVICE

FIELD OF THE INVENTION

This invention relates generally to the field of devices used with CATV systems, and more particularly to an insulated terminator connector.

BACKGROUND OF THE INVENTION

Cable TV (CATV) distribution systems move a cable signal to a tap near a subscriber's house. When a cable installer shuts down service from a subscriber, a 75 ohm terminator connector is installed onto the tap port which is on the telephone/cable pole. One end of the terminator connector screws into the tap port, after which the drop cable from the house of the subscriber to the pole is then connected to the other end of the terminator connector.

The ground of the drop cable is electrically bonded to the ground potential in the house of the subscriber. It is possible that this ground potential is different than the ground potential at the tap. Thus, connecting the drop cable to the terminator connector can result in an electric shock as current flows from one level of ground to another.

SUMMARY OF THE INVENTION

Briefly stated, an insulated cable attachment device, made of an electrically insulating material, is connectable to a termination connector which is in turn connectable to a tap port for a cable television system. When an installer disconnects service to a subscriber's house, the signal is shut down to the tap port to which the subscriber drop cable is connected. The drop cable is disconnected from the tap port and a terminator connector is connected in its place on the tap port. The installer then installs the insulated cable attachment device onto the terminator connector before connecting the drop cable to the insulated cable attachment device, thereby preventing any difference in ground potentials between the terminal connector and the drop cable from being transmitted to the end of the drop cable near the house.

According to an embodiment of the invention, a device connectable to a termination connector which is in turn connectable to a tap port for a cable television system includes a unitary one-piece body of an electrically insulating material; the unitary one-piece body having first and second portions connected to each other by a shoulder; the first portion defining a first cavity and a second cavity, wherein a part of the first portion adjacent the second cavity includes a plurality of internal threads which are connectable to a corresponding plurality of external threads on the termination connector; the second portion including a plurality of external threads thereon which are connectable to a corresponding plurality of internal threads on a cable connector; and the second portion defining a third cavity, wherein the third cavity accommodates a central conductor of a coaxial cable to which the cable connector is attached.

According to an embodiment of the invention, a method for manufacturing a device connectable to a termination connector which is in turn connectable to a tap port for a cable television system includes the step of making a unitary one-piece body of an electrically insulating material, wherein the unitary one-piece body has first and second portions connected to each other by a shoulder; the first portion defines a first cavity and a second cavity, wherein a part of the first portion adjacent the second cavity includes a plurality of internal threads which are connectable to a corresponding plurality of external threads on the termination connector; the second portion includes a plurality of external threads thereon which are connectable to a corresponding plurality of internal threads on a cable connector; and the second portion defines a third cavity, wherein the third cavity accommodates a central conductor of a coaxial cable to which the cable connector is attached.

According to an embodiment of the invention, a method for preventing electrical shock in a cable television system includes the steps of shutting down a signal to a tap port; disconnecting a drop cable from the tap port; installing a terminator connector on the tap port; installing an insulated cable attachment device on the terminator connector; and connecting the drop cable to the insulated cable attachment device, thereby preventing a potential difference between a ground potential on the terminal connector and a ground potential on the drop cable from being transmitted to an installer.

According to an embodiment of the invention, an insulation device for use with a terminal connector and a coaxial cable connector, the terminal connector having a plurality of terminal external threads at one end and the coaxial cable connector having a plurality of cable connector internal threads, includes a unitary one-piece body of electrically insulating material having a first body portion and a second body portion; wherein a part of the first body portion includes a plurality of first body internal threads which are connectable to the plurality of terminal external threads; and wherein a part of the second body portion includes a plurality of second body external threads connectable to the plurality of cable connector internal threads.

DETAILED DESCRIPTION OF THE PREFERRED EMBODIMENT

Figure 1:
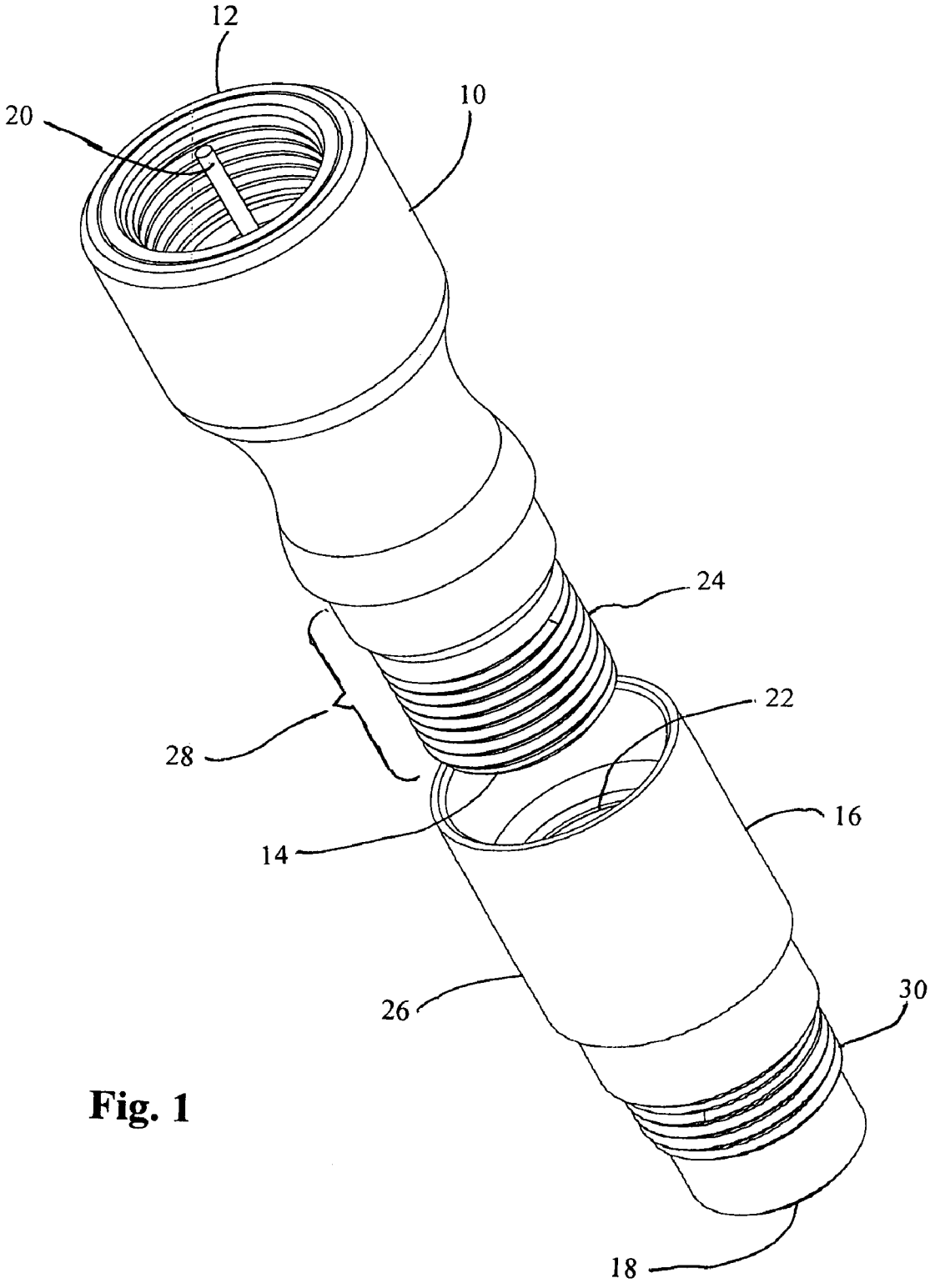
FIG. 1 shows a perspective view of a terminator connector and an insulated cable attachment device according to an embodiment of the invention.
Figure 2:
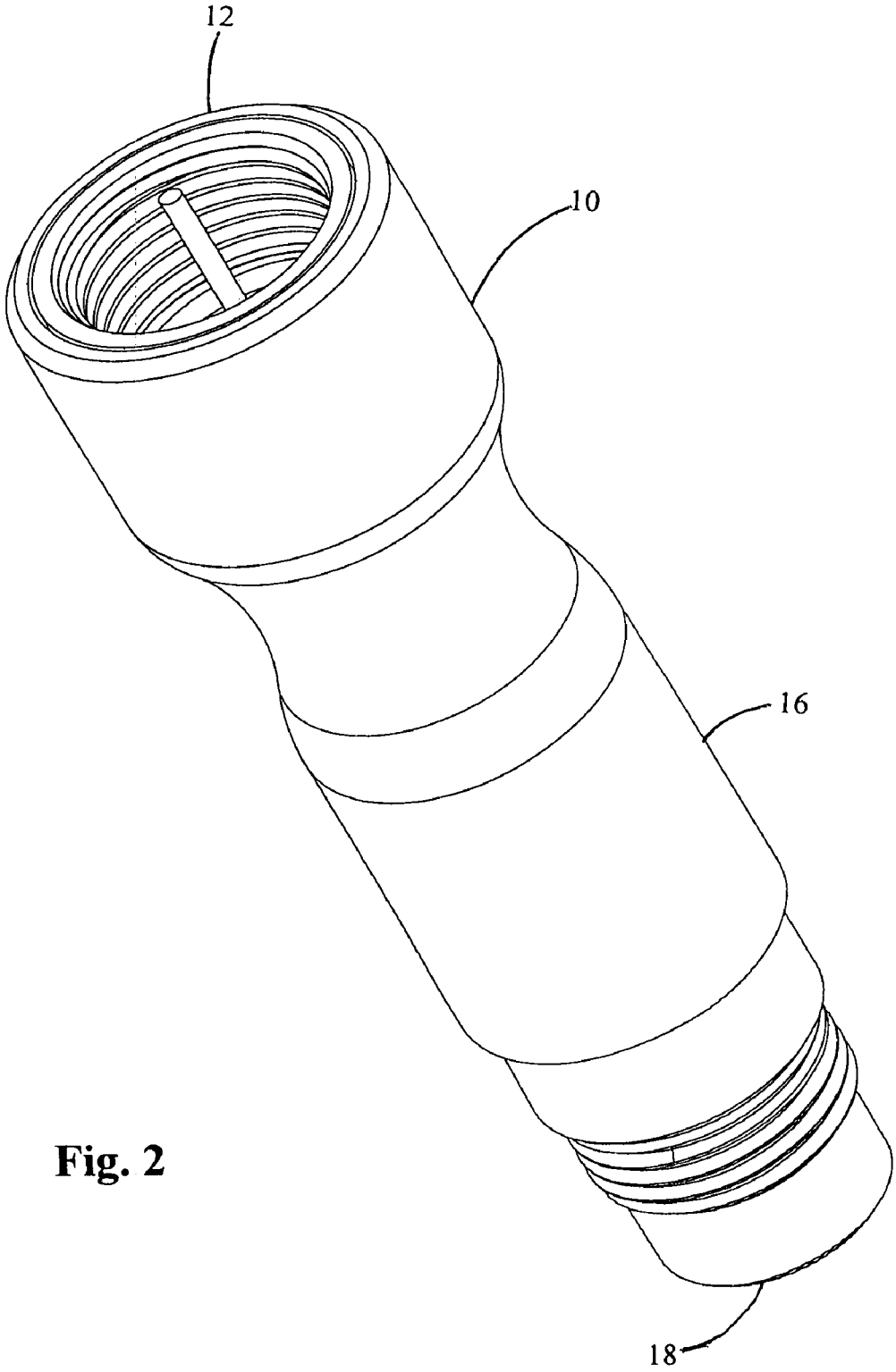
FIG. 2 shows the insulated cable attachment device of FIG. 1 connected to the terminator connector of FIG. 1.
Figure 3:
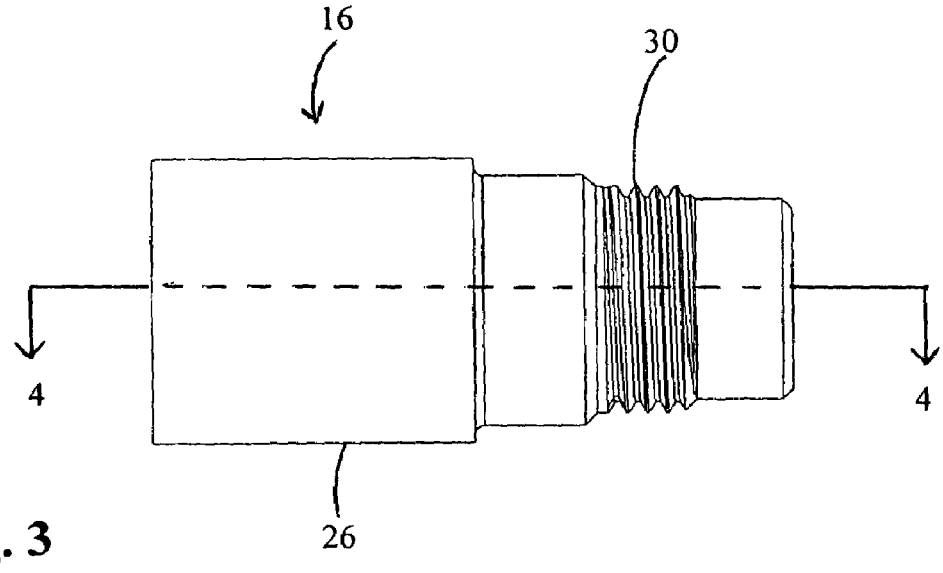
FIG. 3 shows a side elevation view of the insulated cable attachment device of FIG. 1.
Figure 4:
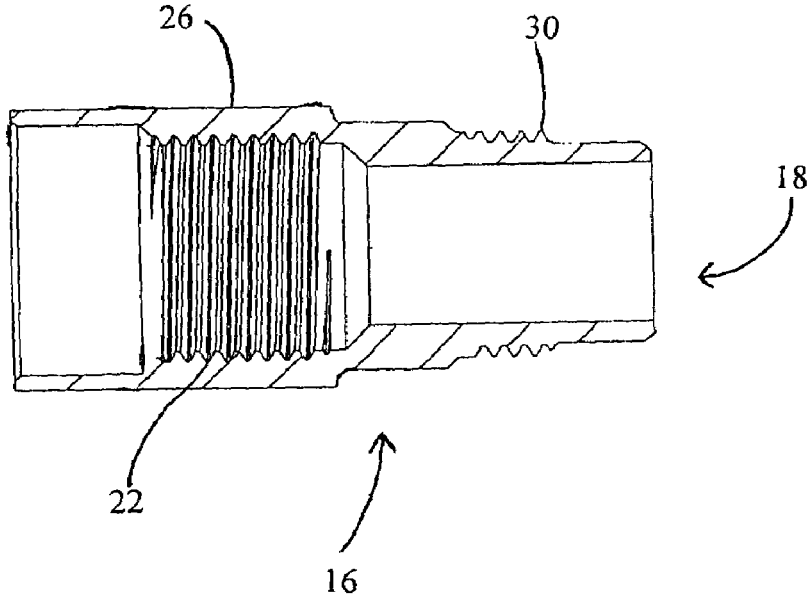
FIG. 4 shows a cross-sectional view of the insulated cable attachment device of FIG. 3 taken across the line 4—4.

Referring to FIGS. 1–4, a conventional 75 ohm terminator connector 10 includes an end 12 which is internally threaded to fit into a tap port (not shown). A conductive pin 20 connects with a corresponding hole in the tap port. The impedance between conductive pin 20 and the outside of terminator connector 10 appears as 75 ohms to the tap port. There is no direct electrical connection between conductive pin 20 and a center conductive wire within a coaxial cable (not shown) or a center conductor of a connector on the coaxial cable when the coaxial cable is connected to terminator connector 10 as is the conventional practice.

An insulator 16, preferably of DELRIN®, includes a plurality of internal threads 22 which correspond to a plurality of external threads 24 on an end 14 of terminator connector 10. Insulator 16 includes a main portion 26 which covers a bottom portion 28 of terminator connector 10 when insulator 16 is screwed onto terminator connector 10. A plurality of external threads 30 on an end 18 of insulator 16 fits the cable connector (not shown) on the end of the coaxial cable (not shown) which comes from the subscriber's location.

During termination of the subscriber's CATV service, an installer unscrews the drop cable (not shown) from the tap port (not shown), screws terminal connector 10 into the tap port (not shown), screws insulator 16 into terminal connector 10, and then screws the drop cable (not shown) onto end 18 of insulator 16. Insulator 16 and terminal connector 10 can also be used in a pre-assembled state. Because there is no electrical connectivity between the ground, i.e., the outside, of terminator 14 and the ground of the drop cable, there is no current flow in the event of unequal ground levels. That is, the drop cable connector is isolated from the tap port.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A device connectable to a termination connector which is in turn connectable to a tap port for a cable television system, comprising:

a unitary one-piece body of an electrically insulating material;

the unitary one-piece body having first and second portions connected to each other by a shoulder;

the first portion defining a first cavity and a second cavity, wherein a part of the first portion adjacent the second cavity includes a plurality of internal threads which are connectable to a corresponding plurality of external threads on the termination connector;

the second portion including a plurality of external threads thereon which are connectable to a corresponding plurality of internal threads on a cable connector; and the second portion defining a third cavity, wherein the third cavity accommodates a central conductor of a coaxial cable to which the cable connector is attached.

2. A device according to claim 1, wherein the first portion covers a shank of the termination connector when the device is screwed onto the termination connector.

3. A device according to claim 1, wherein the unitary one-piece body is made of polyacetal resin.

4. A method for manufacturing a device connectable to a termination connector which is in turn connectable to a tap port for a cable television system, comprising the step of making a unitary one-piece body of an electrically insulating material, wherein:

the unitary one-piece body has first and second portions connected to each other by a shoulder;

the first portion defines a first cavity and a second cavity, wherein a part of the first portion adjacent the second cavity includes a plurality of internal threads which are connectable to a corresponding plurality of external threads on the termination connector;

the second portion includes a plurality of external threads thereon which are connectable to a corresponding plurality of internal threads on a cable connector; and the second portion defines a third cavity, wherein the third cavity accommodates a central conductor of a coaxial cable to which the cable connector is attached.

5. A method according to claim 4, wherein the first portion covers a shank of the termination connector when the device is screwed onto the termination connector.

6. A method according to claim 4, wherein the unitary one-piece body is made of polyacetal resin.

7. An insulation device for use with a terminal connector and a coaxial cable connector, the terminal connector having a plurality of terminal external threads at one end and the coaxial cable connector having a plurality of cable connector internal threads, comprising:

a unitary one-niece body of electrically insulating material having a first body portion and a second body portion;

wherein a part of the first body portion includes a plurality of first body internal threads which are connectable to the plurality of terminal external threads;

wherein a part of the second body portion includes a plurality of second body external threads connectable to the plurality of cable connector internal threads; and wherein the second body portion is adapted to accommodate a central conductor of a coaxial cable to which the cable connector is attached.

8. A device according to claim 7, wherein the unitary one-piece body is made of polyacetal resin.

* * * * *